US005993271A

United States Patent [19]

Hopper

[11] Patent Number: 5,993,271

[45] Date of Patent: Nov. 30, 1999

[54] CATV HOUSING SEIZURE MECHANISM FOR RECEIVING HARDLINE COAXIAL CABLE PIN CONNECTORS

[75] Inventor: Scott R. Hopper, Kent, Wash.

[73] Assignee: Thomas & Betts International, Inc., Sparks, Nev.

[21] Appl. No.: 08/872,610

[22] Filed: Jun. 10, 1997

Related U.S. Application Data

[60] Provisional application No. 60/021,076, Jun. 27, 1996.

[51] Int. Cl.[6] ..... H01R 11/22

[52] U.S. Cl. ..... 439/851; 439/891

[58] Field of Search ..... 439/63, 79, 80, 439/750, 839, 851–853, 876, 879, 883, 891

[56] References Cited

U.S. PATENT DOCUMENTS

| | | | |
|---|---|---|---|
| 2,757,352 | 7/1956 | Turley | 439/879 |
| 4,813,893 | 3/1989 | Sindlinger | 439/879 |
| 4,892,488 | 1/1990 | Nestor et al. | 439/853 |
| 4,983,133 | 1/1991 | Van Scyoc et al. | 439/883 |
| 5,030,131 | 7/1991 | Bochm | 439/883 |
| 5,486,124 | 1/1996 | Wandler | 439/851 |
| 5,613,859 | 3/1997 | Bellantoni et al. | 439/63 |
| 5,756,935 | 5/1998 | Balanovsky et al. | 174/52.1 |
| 5,791,919 | 8/1998 | Brisson et al. | 439/891 |

*Primary Examiner*—Kheim Nguyen
*Assistant Examiner*—Michael C. Zarroli
*Attorney, Agent, or Firm*—Weingarten, Schurgin, Gagnebin & Hayes LLP

[57] ABSTRACT

A cable television (CATV) housing having a screwless seizure mechanism for receiving the center conductor of a coaxial cable is disclosed. The mechanism is mounted on a printed circuit board adjacent an entry port of the CATV housing. One end of the seizure mechanism includes a female terminal for receiving the center conductor of a cooperating CATV coaxial cable when the cable is installed on the entry port. An entry guide is provided which insulates the female terminal as well as directs the center conductor of the CATV cable into the female terminal. A second end of the seizure mechanism is securely mounted to, and in electrical communication with, the printed circuit board. A CATV coaxial cable installed onto the entry port of the CATV housing is placed in electrical communication with internal electronics of the housing while still maintaining signal and power integrity without the need to disassemble the housing to secure the center conductor to the circuit board by a seizure screw.

17 Claims, 5 Drawing Sheets

CATV HOUSING SEIZURE MECHANISM FOR RECEIVING HARDLINE COAXIAL CABLE PIN CONNECTORS

CROSS REFERENCE TO RELATED APPLICATIONS

This application claims priority under 35 U.S.C. § 119(e) to provisional patent application Ser. No. 60/021,076 filed Jun. 27, 1996; the disclosure of which is incorporated herein by reference

STATEMENT REGARDING FEDERALLY SPONSORED RESEARCH OR DEVELOPMENT

Not Applicable

BACKGROUND OF THE INVENTION

Prior art CATV port connectors and seizure mechanisms require a two step process for installation of a CATV cable onto the CATV port. The first step is to install the cable onto the port, where the cable connector is torqued to a specific level and sealed with heat shrink tubing or the like. Next, the installer is required to open the housing and screw down a pin seizure mechanism to make a reliable mechanical and electrical contact between the center conductor of the installed cable and the internal electronics of the housing. In some instances it may be required that modules be removed in order to provide access to the pin seizure mechanism Examples of such arrangements are shown and described in U.S. Pat. No. 3,617,811 to McVoy, U.S. Pat. No. 3,881,160 to Ross, U.S. Pat. No. 4,025,150 to Nordberg et al., and U.S. Pat. No. 5,505,636 to Blum. The CATV housing may be located outdoors such as at the top of a telephone pole or underground, making access to and disassembly of the housing more difficult. Such a process is time consuming, cumbersome and can result in installer induced problems from the removal and installation of the modules of the housing every time a CATV cable is installed or removed. Additionally, the use of a set screw as part of the pin seizure mechanism results in deformation of the center conductor when the screw presses the conductor against a connector block, thus the cable may not easily or reliably be reused.

BRIEF SUMMARY OF THE INVENTION

The present invention provides for simplified installation of a coaxial cable onto the entry port of a CATV housing by including a screwless pin seizure mechanism adjacent the entry port. The pin seizure mechanism has one end secured to a printed circuit board and provides for electrical communication between the mechanism and the circuit board. The second end of the mechanism includes a female terminal configured to receive the center conductor of the CATV cable therein when the CATV cable is installed onto the entry port of the CATV housing. The installation process is performed without the need to open the housing to secure the conductor of the coaxial cable to the internal electronics of the CATV housing while maintaining signal and power integrity.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
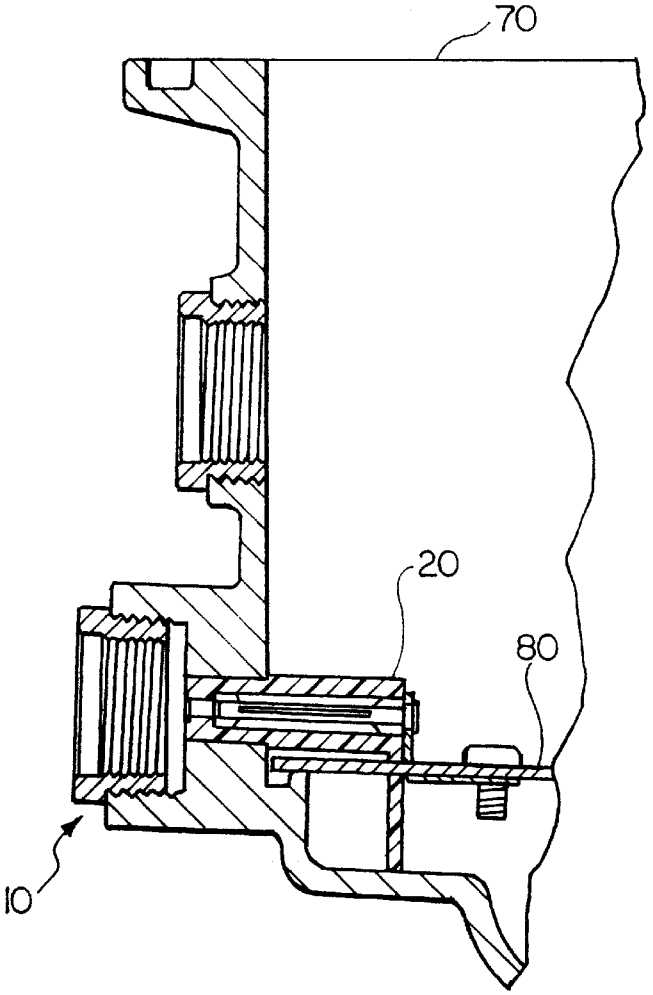
FIG. 1 is a diagram of a CATV housing including the CATV seizure mechanism of the present invention.

FIG. 1 shows a CATV housing 70 including an entry port 10. Disposed adjacent the entry port 10 within the housing is a screwless pin seizure mechanism 20. The seizure mechanism 20 is mounted on, and in electrical communication with, a printed circuit board 80.

Figure 2:
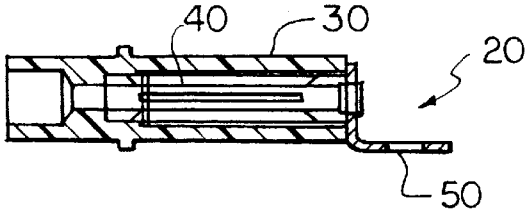
FIG. 2 is a cross-sectional view of an insulator to terminal assembly.
Figure 2A:
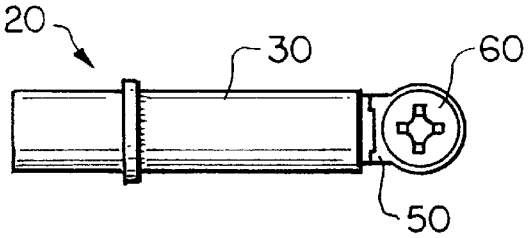
FIG. 2A is a top view of the insulator to terminal assembly of FIG. 2.
Figure 2B:
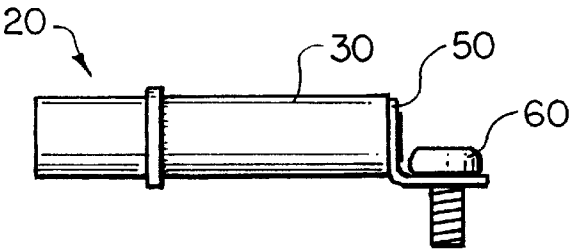
FIG. 2B is a side view of the insulator to terminal assembly of FIG. 2.

Referring now to FIGS. 2–2B, the screwless pin seizure mechanism 20 is shown. Seizure mechanism 20 includes an insulating entry guide 30, a female terminal 40, a bracket 50, and an attachment element 60. While in this embodiment attachment element; 60 is shown as a screw, it should be appreciated that a rivet, epoxy, solder or other attachment means as are known in the art could be used.

Figure 3:
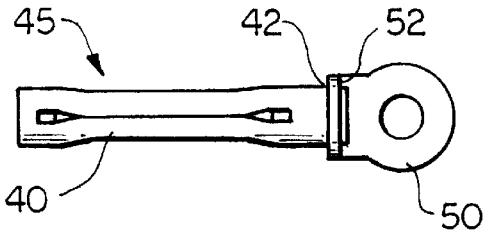
FIG. 3 is a diagram of the terminal and bracket assembly.
Figure 3A:
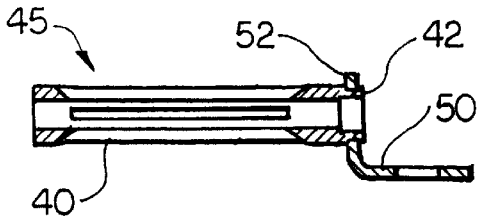
FIG. 3A is a c:ross-sectional diagram of the terminal and bracket assembly of FIG. 3.

FIGS. 3–3A show the terminal to bracket assembly 45. One end 42 of the terminal 40 is attached to one end 52 of the bracket 50. The attachment of terminal 40 to bracket 50 may be provided by soldering, brazing, welding, epoxying using conductive epoxy, crimping, press fitting or by other attachment means as are known in the art. Typically, the terminal end 42 is crimped to bracket 50, and the junction between the two soldered to assure a reliable electrical connection.

Figure 4:
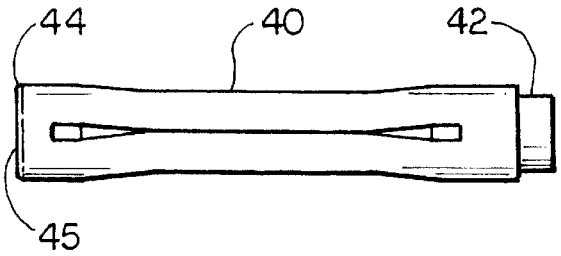
FIG. 4 is a side view of a screwless seizure terminal.
Figure 4A:
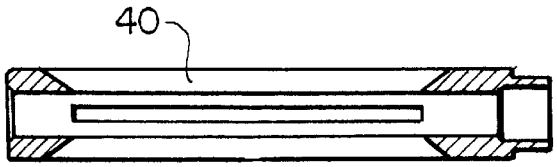
FIG. 4A is a cross-sectional view of the screwless seizure terminal of FIG. 4.
Figure 4B:
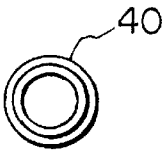
FIG. 4B is an end view of the screwless seizure terminal of FIG. 4.

FIGS. 4–4B show terminal 40. Terminal 40 is comprised of a conductive material, such as brass. Terminal 40 is open on each of a first; end 44 and a second end 42 and includes a central bore 45 disposed therethrough. The first end 44 is configured to receive a center conductor from a coaxial cable therein. The second end 42 of terminal 40 has a smaller diameter than the remaining part of he terminal 40, and is sized to be received within bracket 50 (FIG. 5).

Figure 5:
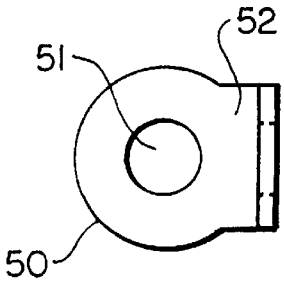
FIG. 5 is a top view of a screwless seizure bracket.
Figure 5A:
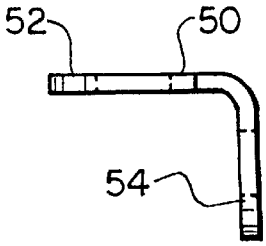
FIG. 5A is a side view of the screwless seizure bracket of FIG. 5.
Figure 5B:
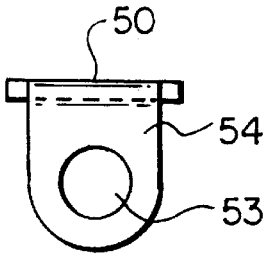
FIG. 5B is a front view of the crewless seizure bracket of FIG. 5.

FIGS. 5–5B show bracket 50, which is comprised of a conductive material, such as steel. Bracket 50 is generally L-shaped in this embodiment through other shapes could be used. A first end 52 of bracket 50 includes a hole 51. Hole 51 is sized to receive the second end 42 of terminal 40 therein. After the second end of terminal 40 is received therein, the two pieces are joined together to form a secure mechanical attachment between the terminal and the bracket as well as provide electrical communication between the two pieces. The second end 54 of bracket 50 also includes a mounting section 53, in this embodiment a hole, which is configured to receive a section of a securing element therethrough. The securing element (not shown) may comprise a screw, rivet, epoxy or other means as are known in the art to provide secure electrical and mechanical attachment of the bracket to a printed circuit board (not shown).

Figure 6:
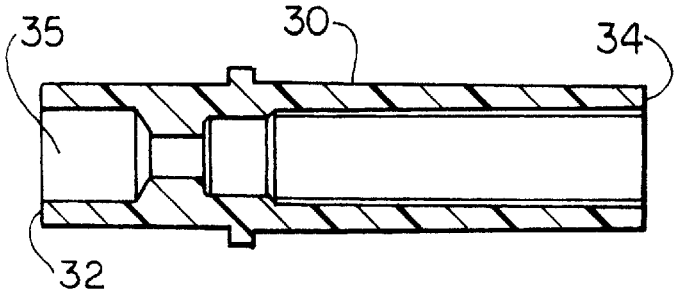
FIG. 6 is a cross-sectional side view of the screwless seizure insulator.
Figure 6A:
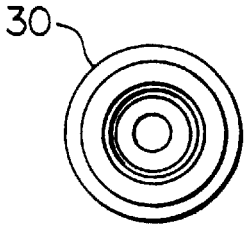
FIG. 6A is an end view of the screwless seizure insulator of FIG. 6.

FIGS. 6–6A show insulating entry guide 30 formed of an insulative material such as DELRIN. Insulating entry guide 30 is open on each of a first end 32 and a second end 34 and includes a central bore 35 extending therethrough. The first end 32 is configured to receive the center conductor from a CATV cable therein. The second end 34 of insulating entry guide 30 is configured to receive a portion of terminal to bracket assembly 45 therein.

Figure 7:
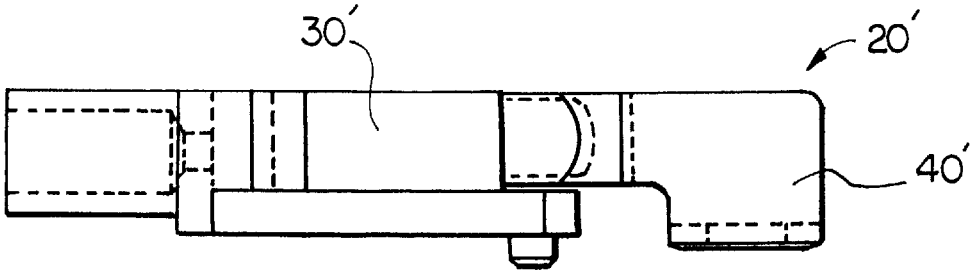
FIG. 7 is top view of an alternate embodiment of a seizure mechanism.
Figure 7A:
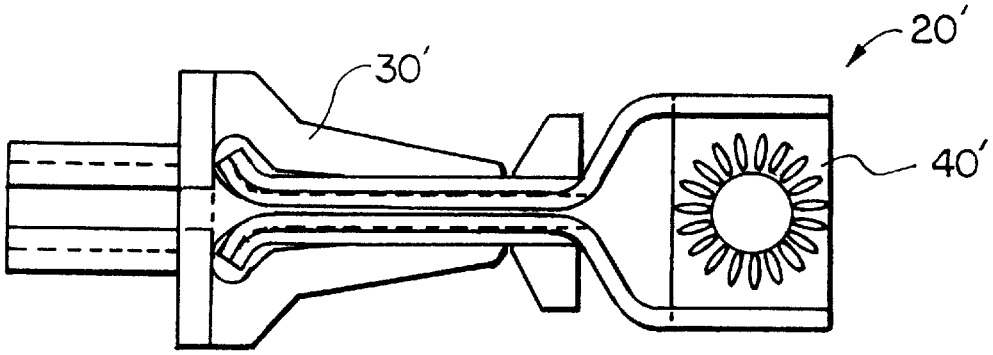
FIG. 7A is a side view of the seizure mechanism of FIG. 7.
Figure 8B:
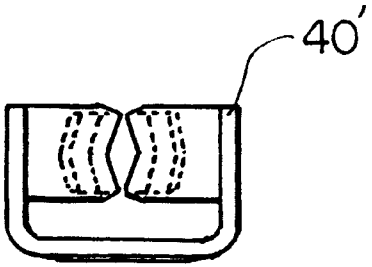
FIG. 8B is an end view of the screwless seizure terminal of FIG. 8.
Figure 8:
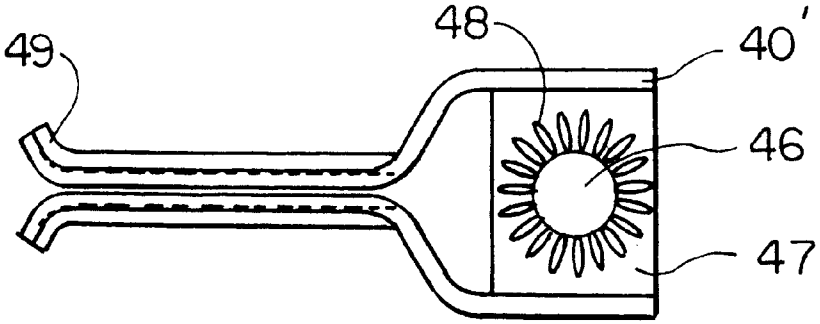
FIG. 8 is a top view of an alternate embodiment of a screwless seizure terminal.
Figure 8A:
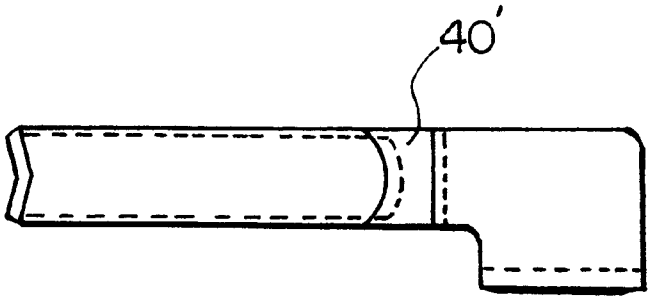
FIG. 8*a* is a side view of the screwless seizure terminal of FIG. 8.

An alternate embodiment seizure mechanism 20' is shown in FIGS. 7–7A. Mechanism 20' comprises a terminal 40' as shown in FIGS. 8–8B and an entry guide 30' as shown in FIGS. 9–9D.

Terminal 40' is comprised of a conductive material, such as brass, and includes an integral bracket. Terminal 40' has a first end comprising a plurality of fingers 49 which have flared ends. The fingers 49 are configured to provide secure electrical and mechanical contact with a center conductor of a cable. While two fingers are shown in this embodiment, it should be appreciated that any number of fingers could be utilized. The fingers 49 flare outward to form sidewalls 43 and a flat surface 47 at a second end of terminal 40'. Flat surface 47 includes a mounting section 46, configured to receive a portion of a connecting element (not shown) therethrough. The top and bottom of flat surface 47 include a plurality of bosses 48 for providing a secure mechanical and electrical connection when the mechanism is assembled onto the circuit board (not shown).

Figure 9:
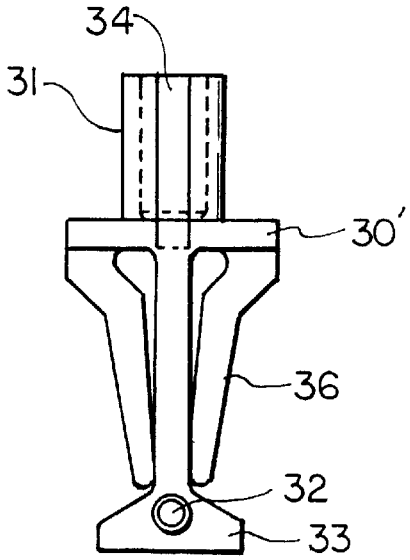
FIG. 9 is a top view of an entry guide.
Figure 9B:
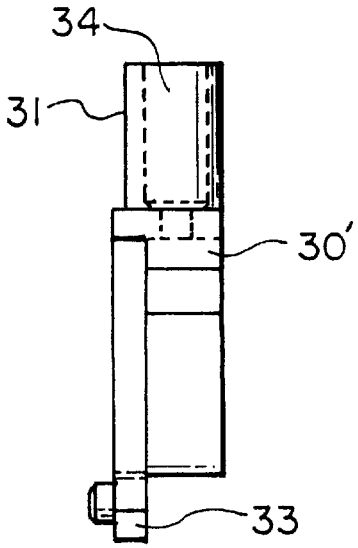
FIG. 9B is a side view of the entry guide of FIG. 9.
Figure 9A:
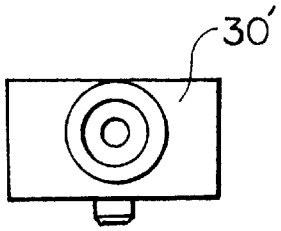
FIG. 9A is an end view of the entry guide of FIG. 9.
Figure 9C:
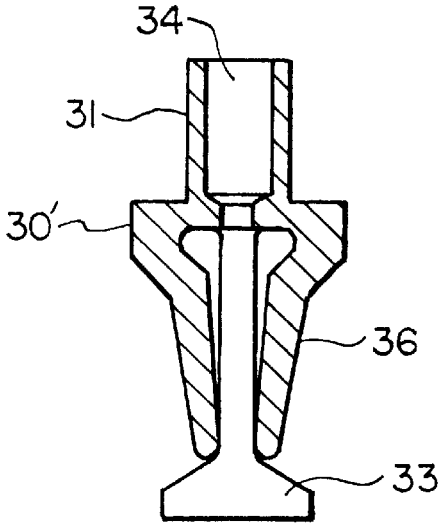
FIG. 9C is a cross-sectional view of the entry guide of FIG. 9.
Figure 9D:
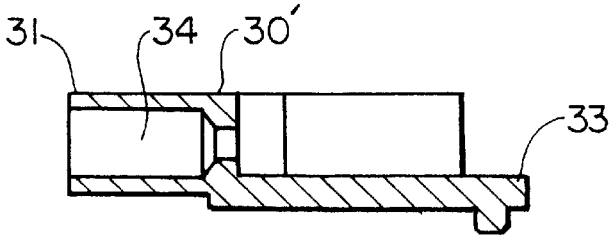
FIG. 9D is a cross-sectional view of the entry guide of FIG. 9.

Entry guide 30' is shown in FIGS. 9–9D and is comprised of an insulative material. Entry guide 30' has a cylindrical first end 31 which includes a central bore 34 disposed therethrough. A second end 33 of entry guide 30' comprises a flat surface including a support leg 32 disposed along a bottom side thereof. A plurality of support fingers 36 are disposed above the flat surface, with the support fingers 36 configured to support a section of terminal 40' therein. While two support fingers 36 are shown in this embodiment, it should be appreciated that any number of support fingers could be utilized.

The pin seizure mechanism 20 is mounted on the circuit board 80 prior to installation of the circuit board within the CATV housing. At this point the mechanism 20 is in electrical communication with the circuit board 80. The pin seizure mechanism 20 is located on the circuit board 80 such that it is adjacent an entry port 10 of the CATV housing 70 when the circuit board 80 is mounted in the housing 70. When a CATV cable is installed onto the entry port 10, the center conductor of the cable is securely received within the terminal 30 of the mechanism 20. The center conductor of the CATV cable is now in electrical communication with the circuit board through seizure mechanism 20. The connection of the center conductor of the cable to the printed circuit board is accomplished without having to disassemble the CATV housing, while power and signal integrity are maintained.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

I claim:

1. A pin seizure mechanism comprising:

a female terminal open on each of two ends and having a bore centrally disposed therethrough, said bore sized to engage and disengage a center conductor of a coaxial cable insertable therein and to provide mechanical and electrical communication between said terminal and the center conductor of the coaxial cable when the center conductor is inserted into said bore;

a bracket having a first end configured to mate with a second end of said terminal, a mounting portion disposed at a second end thereof, and wherein said bracket is secured to said terminal by an attachment means selected from the group consisting of soldering, brazing, epoxying with conductive epoxy, crimping and press fitting; and an entry guide, open on each of two ends and having a bore centrally disposed therethrough, disposed about a first end of said terminal and surrounding a portion of said terminal.

2. The seizure mechanism of claim 1 further wherein the mounting portion has a hole therethrough and further including an attachment element having a portion thereof configured to fit within the mounting hole of said bracket and to provide secure attachment of said bracket to a circuit board.

3. The seizure mechanism of claim 1 wherein said terminal and said bracket are provided as a unitary piece.

4. The seizure mechanism of claim 1 wherein said terminal includes a plurality of fingers.

5. The seizure mechanism of claim 1 wherein said entry guide includes a plurality of support fingers.

6. The seizure mechanism of claim 1 wherein said entry guide includes a support leg.

7. The seizure mechanism of claim 1 wherein said terminal and said bracket are comprised of conductive material.

8. The seizure mechanism of claim 1 wherein said entry guide is comprised of non-conductive material.

9. The seizure mechanism of claim 1 wherein said bracket includes a plurality of bosses disposed on a top surface thereof about said mounting hole.

10. The seizure mechanism of claim 1 wherein said bracket includes a plurality of bosses disposed on a bottom surface thereof about said mounting hole.

11. The seizure mechanism of claim 1 wherein said mechanism is disposed on a circuit board adjacent an entry port within a housing.

12. The seizure mechanism of claim 1 wherein said terminal is comprised of brass.

13. The seizure mechanism of claim 1 wherein said bracket is comprised of steel.

14. The seizure mechanism of claim 2 wherein said attachment element is selected from the group consisting of a screw, a rivet, solder and conductive epoxy.

15. The seizure mechanism of claim 3 wherein said unitary piece is comprised of brass.

16. A pin seizure mechanism comprising:

a female terminal open on each of two ends and having a bore centrally disposed therethrough, said bore sized to engage and disengage a center conductor of a coaxial cable insertable therein and to provide mechanical and electrical communication between said terminal and the center conductor of the coaxial cable when the center conductor is inserted into said bore;

a bracket having a first end configured to mate with a second end of said terminal, and having a mounting portion disposed at a second end thereof;

an entry guide, open on each of two ends and having a bore centrally disposed therethrough, disposed about a first end of said terminal and surrounding a portion of said terminal;

an attachment element having a portion thereof configured to fit within the mounting portion of said bracket and to provide secure attachment of said bracket to a circuit board; and wherein said mechanism is disposed on said circuit board adjacent an entry port within a housing.

17. A pin seizure mechanism comprising:

a female terminal open on each of two ends and having a bore centrally disposed therethrough, said bore sized to engage and disengage a center conductor of a coaxial cable insertable therein and to provide mechanical and electrical communication between said terminal and the center conductor of the coaxial cable when the center conductor is inserted into said bore, said terminal including a plurality of fingers, and including an integral bracket having a mounting portion disposed at a second end thereof;

an entry guide, open on each of two ends and having a bore centrally disposed therethrough, including a plurality of support fingers and a support leg, disposed about a first end of said terminal and surrounding a portion of said terminal;

an attachment element having a portion thereof configured to fit within the mounting portion of said bracket and to provide secure attachment of said bracket to a circuit board; and wherein said mechanism is disposed on said circuit board adjacent an entry port within a housing.

* * * * *